US010339888B2

(12) United States Patent
Kim et al.

(10) Patent No.: US 10,339,888 B2
(45) Date of Patent: Jul. 2, 2019

(54) LIGHT EMITTING DIODE (LED) DRIVING CIRCUIT WITH COMMON CURRENT SENSING RESISTOR AND CONFIGURED TO DRIVE LED GROUPS, METHOD OF DRIVING THE CIRCUIT AND LIGHT APPARATUS HAVING THE SAME

(71) Applicant: Magnachip Semiconductor, Ltd., Cheongju-si (KR)

(72) Inventors: Hyun-jung Kim, Seoul (KR); Seung-hwan Lee, Cheongju-si (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 22 days.

(21) Appl. No.: 14/092,774

(22) Filed: Nov. 27, 2013

(65) Prior Publication Data

US 2015/0084943 A1 Mar. 26, 2015

(30) Foreign Application Priority Data

Sep. 25, 2013 (KR) ..... 10-2013-0114110

(51) Int. Cl.
*G09G 3/34* (2006.01)
*G09G 3/36* (2006.01)
*H05B 33/08* (2006.01)

(52) U.S. Cl.
CPC ..... *G09G 3/3696* (2013.01); *H05B 33/0824* (2013.01)

(58) Field of Classification Search
CPC ..... G09G 3/3406; G09G 2320/0626; G09G 2320/064; G09G 2320/0646
USPC ..... 345/102; 349/61–70; 362/561
See application file for complete search history.

(56) References Cited

U.S. PATENT DOCUMENTS

2009/0146932 A1* 6/2009 Osaka ..... 345/82
2010/0110059 A1* 5/2010 Kang et al. ..... 345/211
2010/0308738 A1* 12/2010 Shteynberg ..... H05B 33/0812 315/185 R (Continued)

FOREIGN PATENT DOCUMENTS

CN 102045923 A 5/2011
CN 102742360 A 10/2012

(Continued)

OTHER PUBLICATIONS

Korean Office Action dated Jul. 16, 2014 in counterpart Korean Application No. KR 10-2013-0114110 (5 pages, in Korean).

(Continued)

*Primary Examiner* — Ram A Mistry
(74) *Attorney, Agent, or Firm* — NSIP Law

(57) ABSTRACT

A light emitting diode (LED) driving circuit that sequentially drive a plurality of series-coupled LED groups comprising at least one LED is provided. The LED driving circuit includes a plurality of mid nodes coupled to terminals of the plurality of the LED groups, a common node with a reference voltage, a switch unit configured to form a plurality of current movement paths between the common node and the plurality of the mid nodes and configured to select a current movement path based on a control signal, a current measuring unit configured to detect a current flow through the common node, and a current control unit configured to generate the control signal based on the detected current flow.

12 Claims, 4 Drawing Sheets

(56) References Cited

U.S. PATENT DOCUMENTS

| | | | | |
|---|---|---|---|---|
| 2012/0126712 | A1* | 5/2012 | Kim | H05B 33/0827 315/187 |
| 2012/0299484 | A1* | 11/2012 | Shin | H05B 33/0866 315/122 |
| 2013/0207559 | A1* | 8/2013 | Ferrier | H05B 33/083 315/192 |

FOREIGN PATENT DOCUMENTS

| | | | |
|---|---|---|---|
| CN | 103096576 | A | 5/2013 |
| CN | 102498449 | B | 6/2014 |
| KR | 10-2011-0007706 | A | 1/2011 |
| KR | 10-2012-0006808 | A | 1/2012 |
| KR | 10-1175934 | B1 | 8/2012 |
| KR | 10-2013-0077641 | A | 7/2013 |
| WO | WO 2013/100736 | A1 | 7/2013 |

OTHER PUBLICATIONS

Korean Office Action dated Jul. 16, 2014 in corresponding Korean Patent Application No. 10-2013-0114110 (5 pages in Korean).

Taiwanese Office Action dated Jun. 29, 2017 in corresponding Taiwanese Patent Application No. 103117808. (11 pages in Chinese).

Chinese Office Action dated Sep. 15, 2017 in corresponding Chinese Patent Application No. 201410132966.0 (6 pages in Chinese).

* cited by examiner

LIGHT EMITTING DIODE (LED) DRIVING CIRCUIT WITH COMMON CURRENT SENSING RESISTOR AND CONFIGURED TO DRIVE LED GROUPS, METHOD OF DRIVING THE CIRCUIT AND LIGHT APPARATUS HAVING THE SAME

CROSS-REFERENCE TO RELATED APPLICATIONS

This application claims the benefit under 35 USC 119(a) of Korean Patent Application No. 10-2013-0114110 filed on Sep. 25, 2013, in the Korean Intellectual Property Office, the entire disclosure of which is incorporated herein by reference for all purposes.

BACKGROUND

1. Field

The present invention relates to a method of driving a light emitting diode (LED) and to a LED driving circuit and a light apparatus using an AC power supply to sequentially drive a plurality of LED groups.

2. Description of Related Art

Light emitting diodes (LEDs) are photoelectric conversion semiconductor devices having a PN-junction structure formed by joining an n-type semiconductor region and a p-type semiconductor region. LEDs emit light by combining electrons and positive holes at the PN-junction structure. In comparison to a conventional light bulb and a fluorescent light, LED exhibits reduced power consumption and extended lifespan. Thus, LEDs may be used in place of the conventional light bulb and fluorescent light for a general light usage.

An LED driving circuit generally uses a DC voltage converted in a common AC power supply through a converter to drive an LED. However, such an LED driving circuit generates a phase difference between a driving voltage and a driving current provided to an LED device. That is, the conventional LED driving circuit may not satisfy a required standard in a product such as a LED light in an environment with electrical characteristics of a power factor and a total harmonic distortion.

U.S. Pat. No. 6,989,807 (Jan. 24, 2006) relates to an LED driving circuit, includes a plurality of LEDs, a voltage detection circuit and a current switching circuit and rearranges LEDs through the current switching circuit to improve a power factor and efficiency in response to a voltage of a power source in the voltage detection circuit being detected.

U.S. Pat. No. 7,081,722 (Jul. 25, 2006) relates to a LED multiphase driver circuit and method, includes an LED group coupled to a ground through separate conductive paths and a phase switch forming each of the paths and turning off a phase switch of an upper LED group to decrease a power loss in response to a phase switch of a lower LED group being turned on.

However, such methods of driving LEDs impose a space limitation (i.e., integration limitation) in a module because the conventional arts detect a level of an AC power supply or use a plurality of sensing resistors for detecting a phase voltage in each of the LED groups. Also, such conventional arts require a logical circuit determining a current movement path according to a level of an AC power supply in each of the LED groups for turning on the LED groups.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a light emitting diode (LED) driving circuit configured to sequentially drive a plurality of series-coupled LED groups comprising at least one LED is provided, the LED driving circuit including a plurality of mid nodes coupled to terminals of the plurality of the LED groups, a common node with a reference voltage, a switch unit configured to form a plurality of current movement paths between the common node and the plurality of the mid nodes and configured to select a current movement path based on a control signal, a current measuring unit configured to detect a current flow through the common node, and a current control unit configured to generate the control signal based on the detected current flow.

The switch unit may include a plurality of the switches, the plurality of the switches being connected to a corresponding mid node and the common node to form a current movement path.

A current flow of the common node may correspond to a sum of currents flowing through the plurality of the current movement paths.

The current measuring unit may include a sensing resistor, the sensing resistor being coupled to the common node to form a feedback loop. The current measuring unit may be configured to detect an amount of a current flowing out from the common node based on a voltage at both sides of the sensing resistor.

The sensing resistor may be located outside of the LED driving circuit.

The current control unit may be configured to differentially amplify a reference voltage set to each of the plurality of the switches and the detected current flow to control a corresponding switch.

The set reference voltage may increase in response to an increase in a distance between an AC power supply and a mid node to which a corresponding switch is coupled.

The current control unit may be configured to turn off a switch in the selected current movement path in response to the current flow increasing to refresh an actual current movement path.

The current flow may increase in response to an increase in a distance between the AC power supply and the selected current movement path.

The current control unit may include a line shape block configured to measure a level of the AC power supply and to control an amount of a current flowing into each of the plurality of the switches so that the detected current flow responds to a change of the AC power supply.

The current control unit may include an output control unit configured to measure a maximum level of the AC power supply to decrease an amount of a current flowing into each of the plurality of the switches up to a ratio in excess of a reference level.

In another general aspect, there is provided a light apparatus including a rectification unit configured to full-wave rectify an AC voltage, a light emitting unit comprising a plurality of series-coupled LED groups, each comprising at least one LED, and a LED driving circuit configured to sequentially drive the plurality of the LED groups. The LED driving circuit may include a plurality of mid nodes coupled to each of terminals of the plurality of the LED groups, a common node with a reference voltage, a switch unit configured to form a plurality of current movement paths between the common node and the plurality of the mid nodes and configured to select a current movement path based on a control signal, a current measuring unit configured to detect a current flow through the common node, and a current control unit configured to generate the control signal based on the detected current flow.

In another general aspect, there is provided a method of driving a plurality of series-coupled light emitting diode (LED) groups each comprising at least one LED, the method involving detecting a current flow through a common node of a driving circuit, the driving circuit comprising the common node, a plurality of mid nodes coupled to terminals of the plurality of the LED groups, a common node with a reference voltage, and a switch unit configured to form a plurality of current movement paths between the common node and the plurality of the mid nodes; generating a control signal based on the detected current flow; and selecting a current movement path from the plurality of current movement paths based on the control signal.

Other features and aspects will be apparent from the following detailed description, the drawings, and the claims.

Figure 1:
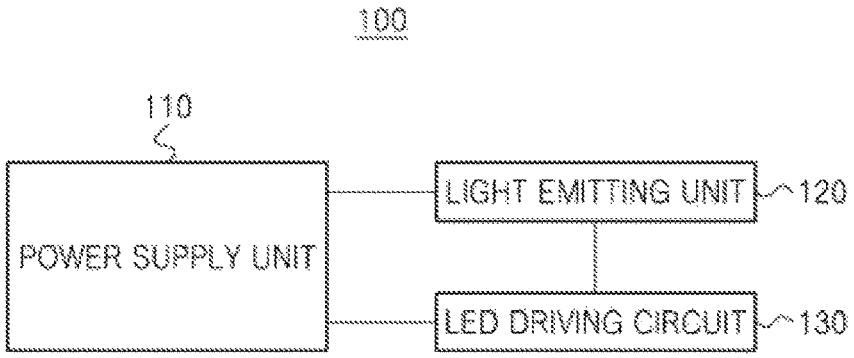
FIG. 1 is a block diagram illustrating an example of a light emitting diode (LED) apparatus.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Terms described in the present disclosure may be understood as follows.

While terms such as "first" and "second," etc., may be used to describe various components, such components must not be understood as being limited to the above terms. The above terms are used only to distinguish one component from another. For example, a first component may be referred to as a second component without departing from the scope of rights of the present disclosure, and likewise a second component may be referred to as a first component.

It will be understood that when an element is referred to as being "connected to" another element, it can be directly connected to the other element or intervening elements may also be present. In contrast, when an element is referred to as being "directly connected to" another element, no intervening elements are present. In addition, unless explicitly described to the contrary, the word "comprise" and variations such as "comprises" or "comprising," will be understood to imply the inclusion of stated elements but not the exclusion of any other elements. Meanwhile, other expressions describing relationships between components such as "~ between", "immediately ~ between" or "adjacent to ~" and "directly adjacent to ~" may be construed similarly.

Singular forms "a", "an" and "the" in the present disclosure are intended to include the plural forms as well, unless the context clearly indicates otherwise. It will be further understood that terms such as "including" or "having," etc., are intended to indicate the existence of the features, numbers, operations, actions, components, parts, or combinations thereof disclosed in the specification, and are not intended to preclude the possibility that one or more other features, numbers, operations, actions, components, parts, or combinations thereof may exist or may be added.

The terms used in the present application are merely used to describe various examples, and are not intended to limit the present disclosure. Unless otherwise defined, all terms used herein, including technical or scientific terms, have the same meanings as those generally understood by those with ordinary knowledge in the field of art to which the present disclosure belongs in view of the present disclosure. Such terms as those defined in a generally used dictionary are to be interpreted to have the meanings equal to the contextual meanings in the relevant field of art, and are not to be interpreted to have ideal or excessively formal meanings unless clearly defined in the present disclosure.

FIG. 1 illustrates an example of a light emitting diode (LED) apparatus.

Referring to FIG. 1, a light emitting diode (LED) apparatus 100 includes a power supply unit 110, a light emitting unit 120 and a LED driving circuit 130.

The power supply unit 110 may be configured to full-wave rectify an AC voltage. For example, the power supply unit 110 may full-wave rectify an AC voltage applied to the LED apparatus to form a pulsating voltage and may provide the pulsating voltage to the light emitting unit 120 and the LED driving circuit 130.

The power supply unit 110 may include a rectification circuit for full-wave rectifying the AC voltage. The rectification circuit may be, for example, implemented as a bridge diode.

The power supply unit 110 may not require a separate converter that converts the AC voltage into a relatively uniform DC voltage.

The light emitting unit 120 may include a plurality of series-coupled LED groups, and each of the LED groups may include at least one LED.

Herein, in the event that an LED group includes a plurality of LEDs, the plurality of the LEDs may be coupled in series, in parallel or in combination according to product applications. Also, each of the plurality of the LEDs may include a resistor component. The resistor component may be coupled to the plurality of the LEDs in series or in parallel.

The LED driving circuit 130 is coupled to one terminal of the light emitting unit 120 and the power supply unit 110 to form a plurality of current movement paths for the light emitting unit 120 to determine a specific current movement path based on a current flow of the LED driving circuit 130 (e.g., total amount of a current).

Figure 2:
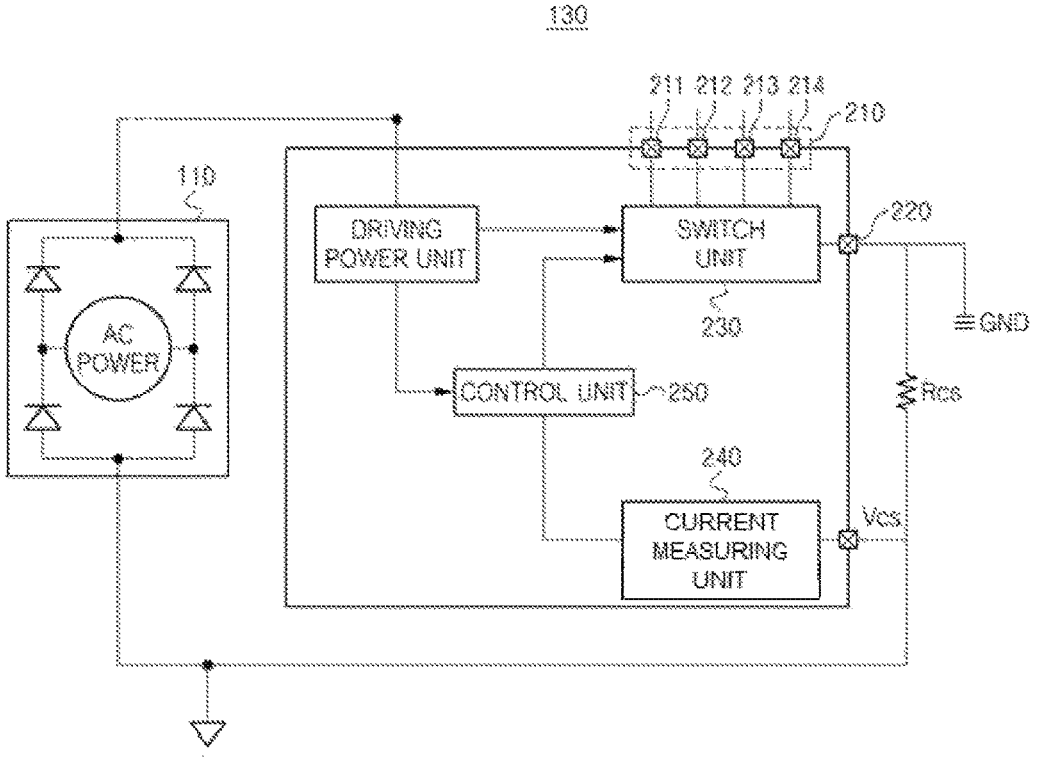
FIG. 2 is a block diagram illustrating an example of an LED driving circuit in the LED apparatus illustrated in FIG. 1.

FIG. 2 illustrates an example of a light emitting diode (LED) driving circuit of an LED apparatus according to FIG. 1.

Referring to FIG. 2, the LED driving circuit 130 includes mid nodes 210, a common node 220, a switch unit 230, a current measuring unit 240 and a current control unit 250.

The mid nodes 210 are coupled to a terminal in each of the plurality of the LED groups. For instance, the mid nodes 210 are coupled to a rear terminal in each of the LED groups, and the rear terminal corresponds to a cathode through which a current flows out according to a current flow.

For example, the light emitting unit 120 may include a first through fourth LED groups in series, and the LED driving circuit 130 may include a first through fourth mid nodes 211 through 214. In this example, the first mid node 211 corresponds to a node being coupled to the first and second LED groups (i.e., a node being in the rear terminal of the first LED group). Similarly, the second through fourth mid nodes 212 through 214 corresponds to nodes being in the rear terminals of the second through fourth LED groups.

The common node 220 corresponds to a node having a reference voltage. For instance, the common node 220 is applied to an external reference voltage, and the common node 220 may be coupled to a ground GND to cause the reference voltage to have a value of 0 [V].

The switch unit 230 couples the common node 220 to each of the plurality of the mid nodes or cuts the common node 220 off from each of the plurality of the mid nodes.

In one example, the switch unit 230 includes a plurality of switches being coupled to each of the mid nodes 210 and the common node 220 to form a current movement path. Herein, each of the plurality of the switches is turned on or turned off based on a control signal to form a current movement path between the mid nodes 210 and the common node 220.

In one example, each of the plurality of the switches may be implemented as a Metal Oxide Silicon Field Effect Transistor (MOSFET). For example, each of the plurality of the switches may be implemented as a high voltage NMOS for having AC voltage durability.

Figure 3:
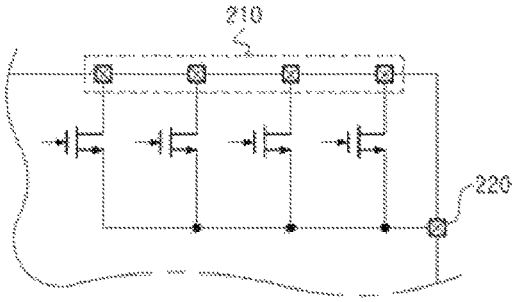
FIG. 3 is a circuit diagram illustrating an example of a switch unit in the LED driving circuit of FIG. 2.

FIG. 3 is a circuit diagram illustrating an example of a switch unit of an LED driving circuit according to FIG. 2.

Referring to FIG. 3, the switch unit 230 includes four MOSFETs being coupled in parallel to the mid nodes 210 and the common node 220.

Herein, a drain and a source of each of the MOSFETs are coupled to a corresponding one of the mid nodes 210 and the common node 220, and each of the MOSFETs operates based on the control signal received through a corresponding gate.

A voltage applied between a gate and a source in the MOSFET (i.e., saturation voltage flowing through MOSFET according to the control signal) may increase. In response to a voltage applied between a drain and a source of the MOSFET increasing, a current flowing through the MOSFET may increase within a saturation voltage range.

The switch unit 230 may control an amount of a current flowing through the plurality of the LED groups in response to the control signal.

Referring back to FIG. 2, the current measuring unit 240 is configured to detect a current flow of the common node 220.

For instance, the current measuring unit 240 may determine a total amount of a current flowing out from the LED driving circuit 130 and the total amount of the current may correspond to a summation of a current flowing into at least one of the plurality of the LED groups and a current being consumed for driving the LED driving circuit 130.

In one example, the current measuring unit 240 may include a feedback loop. The feedback loop includes a voltage measuring terminal $V_{cs}$ and a sensing resistor $R_{cs}$. The voltage measuring terminal $V_{cs}$ is coupled to one terminal of the power supply unit 110. The sensing resistor $R_{cs}$ is located outside and is coupled between the voltage measuring terminal $V_{cs}$ and the common node 220.

A voltage of the voltage measuring terminal $V_{cs}$ (i.e., voltage across the sensing resistor $R_{cs}$) is represented as a multiplication of an amount of a common current $I_c$ and a size of the sensing resistor $R_{cs}$ (i.e., $V_{cs}=-I_c*R_{cs}$). The common current $I_c$ flows into externals through the common node 220. The current measuring unit 240 detects an amount of a current in the common node 220 based on the voltage of the voltage measuring terminal $V_{cs}$ and may estimate a status of an AC input voltage.

The current control unit 250 generates the control signal for controlling the switch unit 230 based on the detected current flow.

In one example, the current control unit 250 may detect a variation of a current detected through the current measuring unit 240 to select a current movement path in inner of the switch unit 230.

Hereinafter, an example of an operation of the current control unit 250 will be described in detail.

The LED driving circuit 130 receives a full-wave rectified power supply voltage, and a driving current rises due to an internal component of the LED driving circuit 130. In response to the power supply voltage being sufficiently high, the LED driving circuit 130 operates due to a set of an internal bias.

An amount of a current flowing through an LED is generally small due to LED characteristics when a voltage being supplied to the LED is less than or equal to a threshold voltage. However, the amount of the current flowing through the LED rapidly increases when the voltage being supplied to the LED is more than the threshold voltage. A threshold voltage in each of the plurality of the LED groups may be determined according to at least one LED included in a corresponding LED group and a topology configuration thereof. When a voltage applied to each of the plurality of the LED groups is more than a corresponding threshold voltage, a current in a corresponding LED group may flow.

In the current control unit 250, a power supply voltage sequentially flows through the plurality of the LED groups in response to the power supply voltage being greater than threshold voltages of the plurality of the LED groups and a variation of an amount of a current being step-increased. The current control unit 250 may control the switch unit 230 to form an optimal current movement path.

Figure 4:
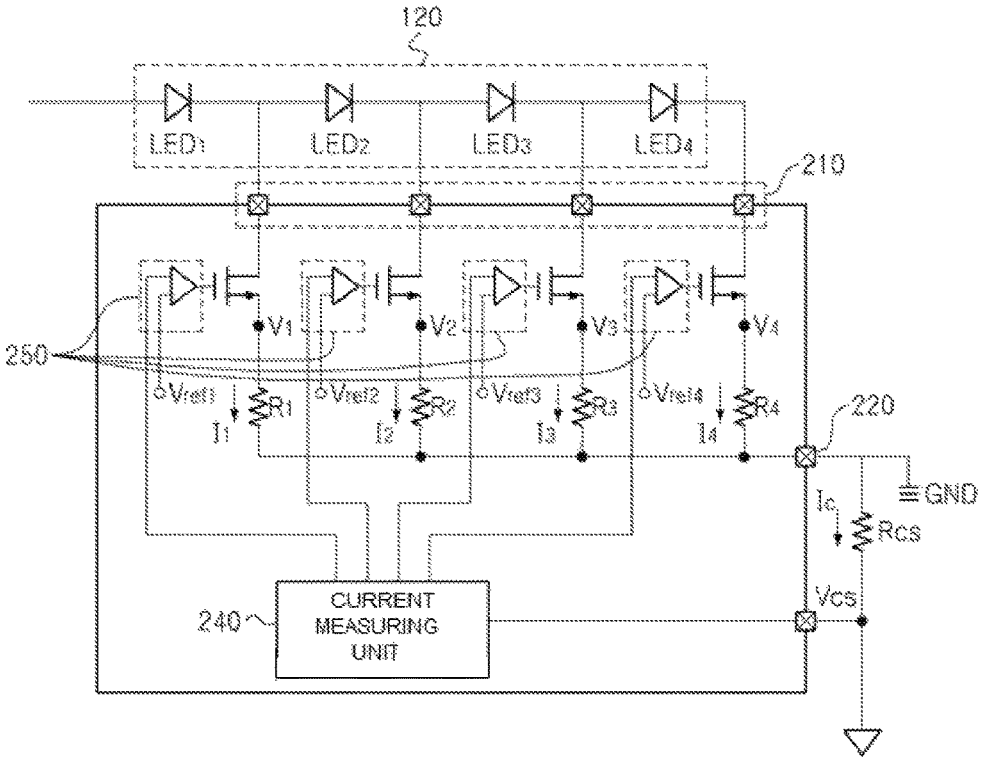
FIG. 4 is a circuit diagram illustrating an example of a current control unit in the LED driving circuit of FIG. 2.

FIG. 4 is a circuit diagram illustrating an example of a current control unit of an LED driving circuit according to FIG. 2.

Referring to FIG. 4, the light emitting unit 120 includes four LEDs, each being respectively included in four LED groups (i.e., LED1 through LED4). In an example of the light emitting unit 120, the switch unit 230 includes four switches respectively corresponding to the four LEDs. Each of the four switches may be implemented with an NMOS-FET and may include a resistor component.

The current control unit 250 includes four amplifiers respectively corresponding to the four switches. An input terminal in each of the amplifiers is coupled to an output terminal of the current measuring unit 240 and each of reference voltages $V_{ref1}$ through $V_{ref4}$. In this example, the current measuring unit 240 may be implemented as a combination of a current source, an amplifier and a resistor, and an output voltage of the current measuring unit 240 may be in proportion with a detected current.

The reference voltages $V_{ref1}$ through $V_{ref4}$ may be set during a manufacturing procedure. In response to an increase of a distance between a mid node being coupled to a corresponding switch (i.e., one of mid nodes 211 through 214) and an AC power supply, a corresponding reference voltage may relatively increase. For example, each of the reference voltages $V_{ref1}$ through $V_{ref4}$ may be increasingly set, and thereby the reference voltage $V_{ref1}$ may be set to a value of 1 [V], and the reference voltages $V_{ref2}$ through $V_{ref4}$ may be increasingly set by a value of 10 [mV] with regard to the reference voltage $V_{ref1}$.

Each of the amplifiers differentially amplifies one of the reference voltages $V_{ref1}$ through $V_{ref4}$ and an output of the current measuring unit 240 to generate the control signal. The control signal is supplied to a gate of the switches. In response to an output voltage of the current measuring unit 240 being greater than a corresponding reference voltage (i.e. one of the reference voltages Vref1 through Vref4), a corresponding switch is turned off and when the output voltage is less than the corresponding voltage, the corresponding switch maintains a turn-on state.

Hereinafter, another example of an operation of the LED driving circuit will be described based on a power supply voltage $V_{in}$.

First, when the power supply voltage $V_{in}$ is applied to the LED driving circuit 130 and the power supply voltage $V_{in}$ is less than a threshold voltage of the first LED ($LED_1$), there is substantially no current flowing out though the common node 220 via the switches. Accordingly, an output voltage of the output measuring unit 240 has a value of substantially 0, and all of the switches are maintained in a turn-on state.

Second, in response to the power supply voltage $V_{in}$ increasing and the power supply voltage $V_{in}$ being more than a threshold voltage of the first LED ($LED_1$), a voltage of the first mid node is more than the first reference voltage. In such an event, a small amount of a current $I_1$ flows through the first switch according to a voltage between terminals of the first switch. A current $I_c$ flowing out through the common node 220 (hereinafter, referred to as a common current) may correspond to a current $I_1$ flowing through the first switch.

Herein, the common current $I_c$ is substantially equal to a current flowing through the light emitting unit 120. Hereinafter, the common current $I_c$ is assumed to be the same as the current flowing through the light emitting unit 120. This is because an amount of a driving current according to a driving of the LED driving circuit 130 is relatively small in comparison to the current flowing through the light emitting unit 120.

Meanwhile, the current measuring unit 240 is configured to detect a current of the common node 220 to provide a corresponding voltage to the current control unit 250. As described above, the current measuring unit 240 may detect the current of the common node 220 through a feedback loop.

The current $I_c$ detected in the current measuring unit 240 is substantially equal to the current $I_1$ flowing through the first switch (i.e., $I_c=I_1$ when the driving current for the LED driving circuit 130 is ignored) and the current measuring unit 240 outputs a voltage having a value of $I_c*k$ (constant) to provide the voltage to the current control unit 250.

The current control unit 250 amplifies a difference in voltage between the first reference voltage $V_{ref1}$ and an output voltage of the current measuring unit 240 through an amplifier to provide the difference in voltage to the first switch. When the output voltage of the current measuring unit 240 is less than the first reference voltage $V_{ref1}$ (i.e., $I_c*k<V_{ref1}$), the first switch maintains a turn-on state. Herein, a timing point in which the first switch maintains a turn-on state (i.e., a timing point in which the first switch turns off) is determined based on values of k and $V_{ref1}$.

The second through fourth switches maintain turn-on states in a similar manner to the first switch because the second through fourth reference voltages $V_{ref2}$ through $V_{ref4}$ of the second through fourth switches is higher than the first reference voltage $V_{ref1}$. However, when the power supply voltage $V_{in}$ is not more than a threshold voltage of the second through fourth LEDs ($LED_2$ . . . $LED_4$), a current may not flow through the second through fourth switches. Rather, the current may flow through a current movement path being formed by the first switch.

Third, in response to the power supply voltage $V_{in}$ increasing and the power supply voltage $V_{in}$ being greater than a summation of threshold voltages in the first and second LEDs ($LED_1$, $LED_2$), a small current $I_2$ flows through the second switch.

The current control unit 250 is configured to amplify a voltage difference between the second reference voltage $V_{ref2}$ and an output voltage of the current measuring unit 240 through an amplifier to provide the difference in voltage to the second switch. In response to the output voltage of the current measuring unit 240 being less than the second reference voltage $V_{ref2}$ (i.e., $I_1*I_2*k<V_{ref2}$), the second switch maintains a turn-on state.

Meanwhile, the current control unit 250 is configured to amplify a difference in voltage between the first reference voltage $V_{ref1}$ and an output voltage of the current measuring unit 240 through an amplifier to provide the voltage difference to the first switch. In the event that the output voltage of the current measuring unit 240 is greater than the first reference voltage $V_{ref1}$ (i.e., $I_1*I_2*k>V_{ref1}$), the first switch is turned off.

When the power supply voltage $V_{in}$ is not more than a threshold voltage of the third and fourth LEDs ($LED_3$, $LED_4$), a current may not flow through the third and fourth switches, and the current flows through a current movement path being formed by the second switch.

Fourth, in response to the power supply voltage $V_{in}$ increasing and the power supply voltage $V_{in}$ being greater than a summation of threshold voltages in the first through third LEDs ($LED_1$ . . . $LED_3$) or the first through fourth LEDs ($LED_1$ . . . $LED_4$), the current control unit 250 calculates a difference voltage between each of the reference voltages $V_{ref1}$ through $V_{ref4}$ in the plurality of the switches and an output voltage of the current measuring unit 240 to control an operation in each of the first through fourth switches.

Fifth, in response to the power supply voltage $V_{in}$ decreasing, the LED driving circuit operates in the other way as described above.

When a maximum voltage of the power supply voltage $V_{in}$ is less than a summation of threshold voltages in the first through fourth LEDs ($LED_1$ . . . $LED_4$), a current $I_4$ flowing through the fourth LED ($LED_4$) may correspond to a value of 0 [A]. When the common current Ic rapidly decreases (i.e., $Ic*k<V_{ref3}$), the third switch is turned on and the current I3 flows through the third LED ($LED_3$).

In response to a level of the power supply voltage $V_{in}$ decreasing, the current control unit 250 may control operations of the first through fourth switches as illustrated above.

Therefore, the LED driving circuit 130 may set an optimum current movement path without a separate logic circuit for determining a current movement path according to a level of an AC power.

Figure 5:
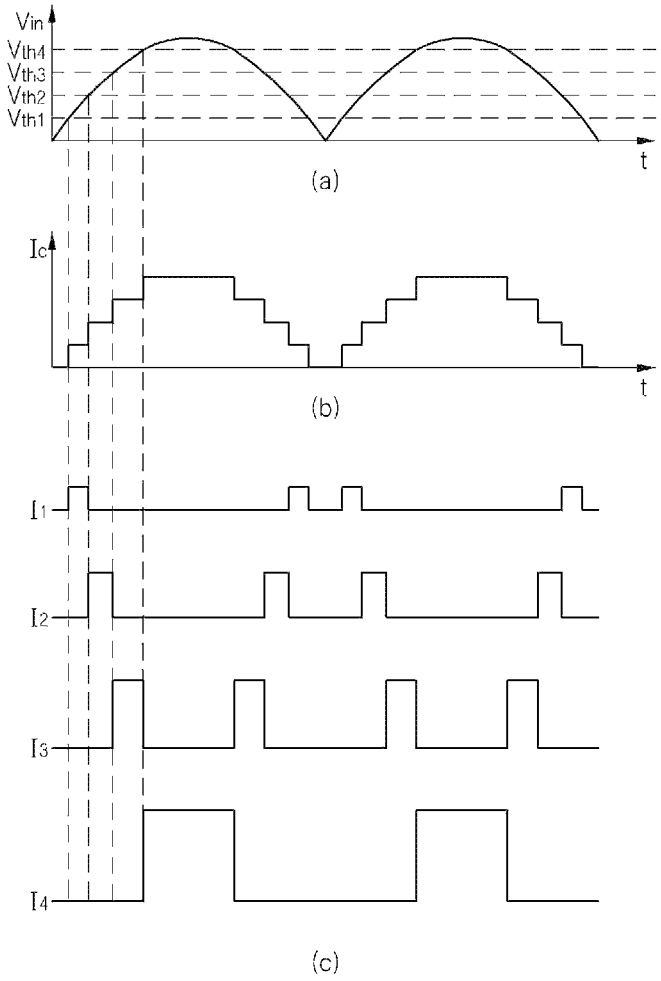
FIG. 5 is a waveform diagram illustrating an example of an operation of an LED driving circuit of FIG. 1.

FIG. 5 is a waveform diagram illustrating an operation of an LED driving circuit according to FIG. 1.

In FIG. 5(*a*), the power supply voltage $V_{in}$ corresponds to a pulsation voltage generated by full-wave rectifying an AC voltage.

In FIG. 5(*b*), the common current Ic corresponds to a current flowing out of the LED driving circuit 130 through the common node 220. The common current Ic indicates a stepped waveform being changed step by step when the power supply voltage $V_{in}$ increases or decreases to correspond to a specific voltage $V_{th1}$, $V_{th2}$, $V_{th3}$ or $V_{th4}$.

The common current is not changed before the power supply voltage $V_{in}$ is greater than a first specific voltage $V_{th1}$. Herein, the first specific voltage $V_{th1}$ may correspond to a threshold voltage of the first LED group. Before the power supply voltage $V_{in}$ is more than the threshold voltage of the first LED group, a current does not flow through the common node 220 via the mid nodes 211, 212, 213, 214, and thereby the switches maintains a turn-on state.

When the power supply voltage $V_{in}$ is greater than the threshold voltage of the first LED group, a small current passing through the first LED group may be applied to the common node 220 through the first mid node 211 and the first switch.

The current control unit 250 may sense a variation of the small current to determine a current movement path so that a current of the light emitting unit 120 flows into the first switch. The common current $I_c$ is saturated to maintain a constant value before the power supply voltage $V_{in}$ is more than a second specific voltage $V_{th2}$. Herein, the second specific voltage $V_{th2}$ may correspond to a summation of each of the threshold voltages in the first and second LED groups. As described above, when the power supply voltage $V_{in}$ is more than the second specific voltage $V_{th2}$, a small current passing into the second LED group is applied to the common node 220 through the second mid node 210 and the second switch.

The current control unit 250 may sense a variation of the small current to refresh the current movement path so that a current of the light emitting unit 120 flows through the second switch. That is, the current control unit 250 may turn off the first switch through the control signal.

As described above, the common current $I_c$ is changed in response to the power supply voltage $V_{in}$ increasing to exceed each of third and fourth specific voltages $V_{th3}$ and $V_{th4}$. The current control unit 250 may sense such a change to refresh the current movement path.

The common current $I_c$ may change in the other way in the event that the power supply voltage $V_{in}$ decreases, rather than the power supply voltage $V_{in}$ increasing.

In the event that the power supply voltage $V_{in}$ decreases below the fourth specific voltage $V_{th4}$ from a maximum voltage, the LED current may rapidly decrease because a voltage applied to the fourth LED group is not more than a corresponding threshold voltage. The current control unit 250 may refresh the current movement path based on a current change. That is, the current control unit 250 may turn on the third switch.

In FIG. 5(*c*), waveforms corresponding to currents $I_1$ through $I_4$ that flow through the first through fourth switches are illustrated. A current $I_n$ that flows through an n-th switch has a specific value in response to the power supply voltage $V_{in}$ corresponding to a value between a n-th threshold voltage and a (n+1)-th threshold voltage.

A current $I_1$ flowing through the first switch has a specific value in response to the power supply voltage $V_{in}$ corresponding to a value between the first threshold voltage $V_{th1}$ and the second threshold voltage $V_{th2}$.

Accordingly, as the power supply voltage $V_{in}$ increases, the current movement path is sequentially changed from the first switch to the fourth switch. In response to the power supply voltage $V_{in}$ decreasing from a maximum voltage, the current movement path is sequentially changed from the fourth switch to the first switch.

In one example, the current control unit 250 may further include a line shape block. The line shape block detects a level of the power supply voltage $V_{in}$ and controls an amount of a current flowing into each of the plurality of the switches so that the detected current flow responds to a change of the power supply voltage $V_{in}$. For instance, the line shape block may detect a level of the power supply voltage $V_{in}$. The line shape block may calculate a difference in voltage between the power supply voltage $V_{in}$ and a signal outputted from the current measuring unit 240, and may add the difference into the control signal generated from the current control unit 250 to control an amount of current flowing into each of the plurality of the switches. For example, when the plurality of the switches is respectively implemented as MOSFETs and the line shape block controls so that the control signal applied to the MOSFETs increases in accordance with a level of the power supply voltage $V_{in}$, a maximum value of the current flowing into the MOSFET increases and the current measuring unit 240 may detect the common current $I_c$ being varied in response to a variation of the power supply voltage $V_{in}$.

Figure 6:
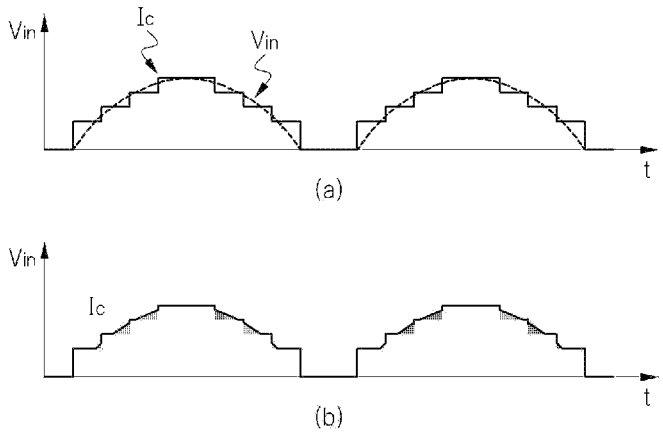
FIG. 6 is a waveform diagram illustrating an example of an operation of an LED driving circuit including a line shape block.

FIG. 6 is a waveform diagram illustrating an operation of an example of an LED driving circuit that includes a line shape block.

In FIG. 6(*a*), a waveform from an LED driving circuit without a line shape block is represented. An x-axis and a y-axis of the waveform respectively represent a time and a level of a power supply voltage $V_{in}$ or an amount of the common current Ic.

As stated above, the power supply voltage $V_{in}$ corresponds to a pulsation voltage, and the common current Ic corresponds to a stepped waveform being varied when the power supply voltage $V_{in}$ is more than a specific voltage (e.g., a threshold voltage of LEDs).

In FIG. 6(*b*), an LED driving circuit with a line shape block is represented, and the common current $I_c$ is varied with a slope per specific section in response to a variation of the power supply voltage $V_{in}$.

The LED driving circuit 130 may increase a current area during a single period (i.e., an average current) to improve a power efficiency and a light efficiency.

In one example, the current control unit 250 may further include an output control unit. The output control unit measures a maximum level of the power supply voltage $V_{in}$ to decrease an amount of a current flowing into each of the plurality of the switches up to a ratio in excess of the reference level.

For example, the output control unit may measure a maximum level of the power supply voltage $V_{in}$, calculate a ratio in excess of a pre-defined reference level and decrease a control signal generated from the current control unit 250 up to the ratio to control an amount of a current flowing into the plurality of the switches.

In response to an LED driving circuit having a reference level of the power supply voltage $V_{in}$ corresponds to a value of 220 [Vrms] and a maximum level of the power supply voltage $V_{in}$ corresponding to a value of 242 [Vrms], the output control unit may measure a maximum level of the power supply voltage $V_{in}$ from the power supply unit 110, calculate a ratio in excess of 220 [V] (i.e., the reference level) as 10% and decrease an amount of a current flowing into each of the plurality of the switches as much as the ratio 10% compared to an amount of a conventional current (a current flowing when a reference level of the power supply voltage $V_{in}$ is applied to the LED circuit).

Figure 7:
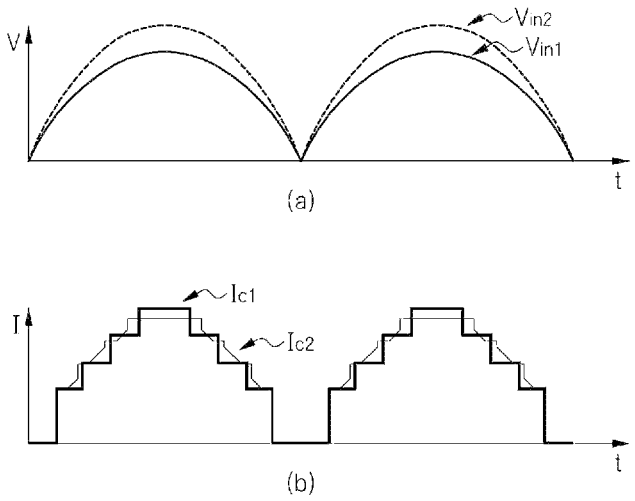
FIG. 7 is a waveform diagram illustrating an example of an operation of an LED driving circuit including an output control unit.

FIG. 7 is a waveform diagram illustrating an operation of an example of an LED driving circuit including an output control unit.

In FIG. 7(*a*), power supply voltages $V_{in1}$ and $V_{in2}$ that are being applied to an LED driving circuit are represented in a waveform. An x-axis and a y-axis of the waveform respectively indicate a time and a level of a power supply voltage $V_{in}$ or an amount of the common current Ic.

A reference power supply voltage $V_{in1}$ and a real power supply voltage $V_{in2}$ are represented in FIG. 7(*a*). A level of the real power supply voltage $V_{in2}$ is more than that of the reference power supply voltage $V_{in1}$.

In FIG. 7(*b*), a reference common current $I_{c1}$ and a real common current Ice in response to the reference power supply voltage $V_{in1}$ and the real power supply voltage $V_{in2}$ are represented.

In an LED driving circuit without an output control unit, the reference common current $I_{c1}$ and the real common current $I_{c2}$ are equal. However, as described above, the real power supply voltage $V_{in2}$ more quickly reaches a specific voltage (e.g., a threshold voltage of LEDs) and the real common current Ice flows during a long time in per section, in comparison to the reference common current $I_{c1}$.

In an LED driving circuit with an output control unit, an amount of the real common current $I_{c2}$ may be decreased with a slope of the calculated ratio. The LED driving circuit 130 may constantly maintain a current area (average current) during a single period in spite of a variation of the power supply voltage Vin to constantly maintain an LED brightness.

In one example, the LED driving circuit 130 may further include a driving power unit.

The driving power unit is coupled to the power supply unit 110 and provides a power supply voltage for an operation of the LED driving circuit 130. For example, the driving power unit may be implemented as JFET (Junction gate field-effect transistor).

Various examples described above relate to a LED driving circuit that allows an easier integration into a light apparatus. For instance, the LED driving circuit may not require a logical circuit for determining a current movement path according to a level of an AC power supply.

The described technology may have the following effects. However, this does not mean that a specific example should include all the following effects or only the following effects, and it should not be understood that a claim scope of the described technology is not limited to the following effects. Rather, the scope of a claim is determined by the language of the claim.

Various examples described above may detect a current of a common node being coupled to LED groups to determine a current movement path of the LED groups thereby an integration into a light apparatus may be easier.

Various examples described above may determine a current movement path based on a variation amount of a current in a common node thereby a logical circuit for detecting a voltage in LED groups may be removed.

While this disclosure includes specific examples, it will be apparent to one of ordinary skill in the art that various changes in form and details may be made in these examples without departing from the spirit and scope of the claims and their equivalents. The examples described herein are to be considered in a descriptive detect only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A light emitting diode (LED) driving circuit configured to drive LED groups being connected to an AC power supply and each LED group comprising at least one LED, the LED driving circuit comprising:

a corresponding mid node respectively connected to an output of each of the LED groups;

a plurality of switches configured to form a current movement path between the corresponding mid node and a common node connected to a predetermined voltage, each switch of the plurality of switches comprising a resistor directly connected to the common node and to the predetermined voltage, and a metal oxide semiconductor field effect transistor (MOSFET);

a sensing resistor having a first terminal directly connected to the common node and to the predetermined voltage;

a current measuring unit connected to a second terminal of the sensing resistor and configured to measure a total amount of current flowing out from the common node based on a voltage drop across the sensing resistor, and to generate an output voltage that is in direct proportion with the measured total amount of current; and a current control unit configured to provide a control signal for controlling the plurality of switches based on the output voltage.

2. The LED driving circuit of claim 1, wherein the total amount of current flowing out from the common node corresponds to a sum of currents flowing through current movement paths formed between respective mid node of the each LED group and the common node and currents consumed to drive the LED driving circuit.

3. The LED driving circuit of claim 1, wherein the current control unit is configured to differentially amplify a difference between a reference voltage set to each of the plurality of the switches and the voltage drop across the sensing resistor to generate the control signal and to control operation of the plurality of the switches through the generated control signal.

4. The LED driving circuit of claim 3, wherein the set reference voltage increases in response to an increase in a distance between a mid node, to which a corresponding switch of the plurality of switches is coupled, and the AC power supply.

5. The LED driving circuit of claim 1, wherein the current control unit is configured to turn off a switch of the plurality of switches in a selected current movement path in response to an increase in an amount of current measured by the sensing resistor to refresh an actual current movement path.

6. The LED driving circuit of claim 1, wherein a current flow increases in response to an increase in a distance between the AC power supply and the formed current movement path.

7. The LED driving circuit of claim 1, wherein the current control unit comprises a line shape block configured to measure a level of the AC power supply and to control an amount of a current flowing into each of the plurality of the switches so that the measured amount of current responds linearly to a change of the AC power supply.

8. The LED driving circuit of claim 1, wherein the current control unit comprises an output control unit configured to measure a maximum level of the AC power supply to decrease an amount of a current flowing into each of the plurality of the switches up to a ratio in excess of a reference level.

9. The LED driving circuit of claim 1, wherein the switch unit is configured to form the current movement path between each of the LED groups and the common node through a plurality of resistors, each directly connected to the common node.

10. The LED driving circuit of claim 1, wherein the LED groups configured to be driven by the LED driving circuit constitute all LED groups capable of being driven by the LED driving circuit.

11. A light apparatus comprising:

a rectification unit configured to rectify an AC voltage to provide a DC power supply;

a plurality of series-coupled LED groups being connected to the rectification unit and each LED group of the plurality of LED groups comprising at least one LED connected to a corresponding mid node; and a LED driving circuit configured to drive the plurality of LED groups, wherein the LED driving circuit comprises:

a plurality of switches configured to form a current movement path between the corresponding mid nodes and a common node connected to a reference voltage, each switch of the plurality of switches comprising a resistor directly connected to the common node and to the reference voltage, and a metal oxide semiconductor field effect transistor (MOSFET);

a sensing resistor having a first terminal directly connected to the common node and to the reference voltage;

a current measuring unit connected to a second terminal of the sensing resistor and configured to measure a total amount of current flowing out from the common node based on a voltage drop across the sensing resistor, and to provide an output voltage that is in direct proportion with the measured total amount of current; and a current control unit configured to generate a control signal for controlling the plurality of switches based on the output voltage.

12. A method of driving light emitting diode (LED) groups connected to an AC power supply, each LED group comprising at least one LED connected to a corresponding mid node, the method comprising:

measuring, using a current measuring unit, a total amount of current flowing out from a common node of a driving circuit based on a voltage drop across a sensing resistor, the driving circuit comprising the common node connected to a reference voltage and to a first terminal of the sensing resistor, a plurality of switches, and the current measuring unit being connected to a second terminal of the sensing resistor;

providing an output voltage that is in direct proportion with the measured total amount of current to a current control unit;

providing a control signal, to each switch of the plurality of switches for controlling the plurality of switches based on the output voltage, each switch comprising a resistor directly connected to the common node and to the reference voltage, and a metal oxide semiconductor field effect transistor (MOSFET); and forming a current movement path between the corresponding mid node and the common node directly connected to the first terminal of the sensing resistor in response to the control signal being input to the plurality of switches.

* * * * *